US008074419B1

(12) United States Patent
Humphress et al.

(10) Patent No.: US 8,074,419 B1
(45) Date of Patent: Dec. 13, 2011

(54) UNBONDED NON-MASONRY BUILDING BLOCK COMPONENTS

(76) Inventors: David L. Humphress, Campbellsville, KY (US); Steven N. Flinchum, Elkhorn, KY (US)

( * ) Notice: Subject to any disclaimer, the term of this patent is extended or adjusted under 35 U.S.C. 154(b) by 827 days.

(21) Appl. No.: 12/168,313

(22) Filed: Jul. 7, 2008

(51) Int. Cl.
*E04C 2/04* (2006.01)
*E04B 1/00* (2006.01)

(52) U.S. Cl. ..... 52/607; 52/284; 52/570; 52/590.2; 52/505; 52/592.6; 52/604; 52/605; 52/288.1; 446/120; 446/124

(58) Field of Classification Search ..... 52/284, 52/309.1, 561, 568, 569, 570, 589.1, 590.1, 52/590.2, 591.1, 592.6, 604–607, 742.13, 52/288.1, 505; 446/120, 124, 127, 128
See application file for complete search history.

(56) References Cited

U.S. PATENT DOCUMENTS

| | | | | | |
|---|---|---|---|---|---|
| 676,803 | A | * | 6/1901 | Shaw | 52/590.1 |
| 1,084,597 | A | * | 1/1914 | Anft | 446/127 |
| 1,338,509 | A | * | 4/1920 | Johnson | 52/284 |
| 1,462,374 | A | * | 7/1923 | Metz | 52/592.6 |
| 1,562,728 | A | | 11/1925 | Albrecht | |
| 1,574,123 | A | * | 2/1926 | Sharpe | 52/314 |
| 1,785,499 | A | * | 12/1930 | Sayers | 52/505 |
| 2,153,913 | A | | 1/1938 | Blackwell | |
| 2,126,011 | A | * | 8/1938 | Hedinger | 52/592.1 |
| 2,392,552 | A | * | 1/1946 | Roe | 52/309.1 |
| 2,460,330 | A | * | 2/1949 | Baccaro | 52/570 |
| 2,594,378 | A | * | 4/1952 | Baldanza | 52/591.5 |
| 2,684,589 | A | * | 7/1954 | Perreton | 52/591.2 |
| 2,902,853 | A | | 9/1959 | Lofstrom | |
| 3,180,060 | A | * | 4/1965 | Persak, Jr. | 52/592.1 |
| 3,552,076 | A | * | 1/1971 | Gregori | 52/309.12 |
| 3,791,090 | A | * | 2/1974 | Kniefel | 52/590.2 |
| 3,849,960 | A | * | 11/1974 | Henry et al. | 52/569 |
| 3,936,987 | A | * | 2/1976 | Calvin | 52/309.1 |
| 3,962,842 | A | | 6/1976 | Wilhelm | |
| 4,038,798 | A | * | 8/1977 | Sachs | 52/309.7 |
| 4,075,808 | A | | 2/1978 | Pearlman | |
| 4,258,522 | A | * | 3/1981 | Amaral | 52/591.2 |
| 4,262,463 | A | * | 4/1981 | Hapel | 52/98 |
| 4,426,815 | A | | 1/1984 | Brown | |
| 4,522,001 | A | * | 6/1985 | Meyer | 52/309.1 |
| 4,566,235 | A | * | 1/1986 | Groll | 52/220.2 |
| 5,024,035 | A | * | 6/1991 | Hanson et al. | 52/591.1 |

(Continued)

FOREIGN PATENT DOCUMENTS

FR 2729684 A1 * 7/1996

*Primary Examiner* — Robert Canfield
*Assistant Examiner* — Charissa Ahmad
(74) *Attorney, Agent, or Firm* — Laura M. Hagan

(57) ABSTRACT

Non-masonry building block components, including a standard hollow-bodied block component with horizontal and vertical locking capabilities which removes the need for bonding material such as glue, mortar or other adhesives. Modified dovetails on the upper and lower surface of the building components prevent vertical movement while resistance locks on each end of the block prevent horizontal movement. Typically, use of the non-masonry building components would allow for constructing permanent or temporary structures having vertical and horizontal channels in which to allow plumbing or electrical conduit. The incorporation of materials, such as sand or similar substance, would form a bullet-resistant barrier for use in military operations. Additionally, structures formed from the block components could easily be assembled or disassembled on site without the need for skilled labor, specialized tools, demolition and clean up.

7 Claims, 9 Drawing Sheets

U.S. PATENT DOCUMENTS 5,379,565 A * 1/1995 Vienne ..... 52/606
5,459,971 A * 10/1995 Sparkman ..... 52/426
5,615,529 A * 4/1997 Johnson et al. ..... 52/604
5,647,185 A * 7/1997 Forlini ..... 52/604
5,729,943 A * 3/1998 Cambiuzzi ..... 52/438
5,826,394 A 10/1998 Barton, Jr. et al.
5,881,512 A 3/1999 Chang
5,899,040 A * 5/1999 Cerrato ..... 52/604
5,992,108 A 11/1999 Falcey
6,122,880 A * 9/2000 Kolb et al. ..... 52/592.6
6,226,951 B1 * 5/2001 Azar ..... 52/604
6,250,986 B1 6/2001 Sorensen
6,253,519 B1 * 7/2001 Daniel ..... 52/591.1
6,616,499 B1 * 9/2003 Sorensen ..... 446/85
6,640,514 B2 * 11/2003 Guibert et al. ..... 52/592.1
6,648,715 B2 * 11/2003 Wiens et al. ..... 446/121
6,735,913 B2 5/2004 Sanders et al.
6,823,638 B2 * 11/2004 Stanchfield ..... 52/588.1
6,962,028 B2 11/2005 Banova
6,996,945 B2 * 2/2006 Doty ..... 52/585.1
7,096,636 B1 * 8/2006 Neill et al. ..... 52/605
7,191,571 B2 3/2007 Schools et al.
7,648,407 B1 * 1/2010 Sorensen ..... 446/120
7,665,269 B2 * 2/2010 Azar ..... 52/592.1
7,694,485 B1 * 4/2010 Siener ..... 52/590.2
7,866,923 B2 * 1/2011 Knudson et al. ..... 405/284
7,971,407 B2 * 7/2011 MacDonald ..... 52/568
2002/0043038 A1 * 4/2002 Cerrato ..... 52/604
2002/0046529 A1 * 4/2002 Nanayakkara ..... 52/606
2002/0152710 A1 * 10/2002 Guibert et al. ..... 52/604
2003/0082986 A1 * 5/2003 Wiens et al. ..... 446/120
2004/0000114 A1 1/2004 Schools et al.
2004/0216418 A1 * 11/2004 Stanchfield ..... 52/589.1
2005/0193676 A1 * 9/2005 Palmersten ..... 52/590.2
2007/0107364 A1 * 5/2007 Estes et al. ..... 52/606
2007/0251183 A1 * 11/2007 Thiagarajan et al. ..... 52/590.1
2008/0184649 A1 * 8/2008 Khan ..... 52/592.6
2009/0193740 A1 * 8/2009 Bennett ..... 52/309.1
2010/0101164 A1 * 4/2010 Broden ..... 52/302.7

* cited by examiner

UNBONDED NON-MASONRY BUILDING BLOCK COMPONENTS

This application was funded by an award from the Kentucky Science and Technology Corporation under Contract #146-403-207.

FIELD OF THE INVENTION

The present invention relates to a non-masonry, durable plastic polymer block system comprising motarless interlocking building blocks designed for easy assembly and disassembly not requiring prior construction knowledge, trade skills or specialty tools. A plurality of modified dove tails horizontally affixed to the upper and lower portion of the blocks allow the blocks to be slideably locked to the upper and lower surfaces of four adjacent blocks. The dovetails of the present invention have been structurally modified to allow multiple drop points from which the dovetails of vertically adjacent blocks can be lowered. By sectioning the dovetails of the upper surface and lower surface of the building blocks the maximum horizontal distance necessary to adjoin two adjacent building components is minimized making construction less cumbersome while providing a secure connection.

Additionally, a resistance-locking feature is disposed on each end of each block to provide an additional end to end connection for two adjacent blocks. The dual locking features of the components allow a total of six adjacent blocks to be affixed and locked, vertically an horizontally, into place. Openings within each block component allows for the resulting temporary or permanent structures to be outfitted with electrical wiring, plumbing, additional insulation, impact absorbing material and/or support members.

BACKGROUND OF INVENTION

The innovative building block components were designed to address problems that exist in current masonry and non-masonry block systems. Presently, a vast majority of blocks used for construction are made of concrete, terra cotta or similar substance and are joined using mortar or other bonding agent. In other prior art the weight and friction of the blocks represents the sole means of staying the individual components. Non-masonry building components that have been previously developed in a polymer form often require additional rebar or adhesives which permanently affix the components to one another. This practice limits the life of the building components to a single use that requires demolition and cleanup when the structure is no longer viable, producing waste materials for disposal.

In the prior art a single fault in the bonding material results in a loss of structural integrity for the structure as a whole. Unlike bonded masonry blocks the material of the present invention and secure dual locking connection means resists compromise from extraneous variables due to weather, earthquakes, poor construction knowledge or the stress on the materials due to the construction process.

Additionally, the proposed building block system can be used to address a long felt need in the area of military construction. By filling the hollow-bodied embodiment of the present invention with sand or similar on-site materials, the blocks create an effective insulated and bullet resistant shelter while maintaining the mobility and ease of installation necessary in wartime situations. The building components of the present invention can also be mobilized over rough terrain without risk of structural compromise.

SUMMARY OF THE INVENTION

An embodiment of the present invention is a reusable block system that provides integrated horizontal and vertical hollows for outfitting permanent or temporary structures with both electrical wiring and plumbing while leaving both the external and internal surfaces of the finished structure aesthetically pleasing. The resulting system would be comprised of components that were dimensionally equivalent to that of standard masonry blocks for smooth building plan conversion.

Three blocks make up the basic block system, which includes, a base block, a left corner block and a right corner block that are all made of a virtually indestructible polymer plastic, or equivalent material, which is both water, pest and earthquake resistant. Unlike standard masonry blocks the material of the present invention can be easily tooled without destroying the integrity of the block.

The standard blocks or, base block components, are comprised of modified sliding dovetails and resistance lock features which allow the blocks to self-align, self plumb and self level without the need for bonding agents, special tools or highly skilled labor. The ease of assembly can also be readily reversed to disassemble a structure while maintaining the structural integrity of the blocks for future use. This application is of particular interest to military and disaster relief efforts that often need fast, temporary structures that can be removed without demolition equipment.

In addition, the lack of necessity for adhesives or mortar allows the blocks to be quickly utilized in any environment or climatic conditions without the need to wait for bonding agents to dry, or set. Without bonding agents a more readily useable product is produced for the untrained consumer while limiting the amount of on-site materials, bonding application tools and time spent on a site.

DETAILED DESCRIPTION OF THE INVENTION

Figure 1:
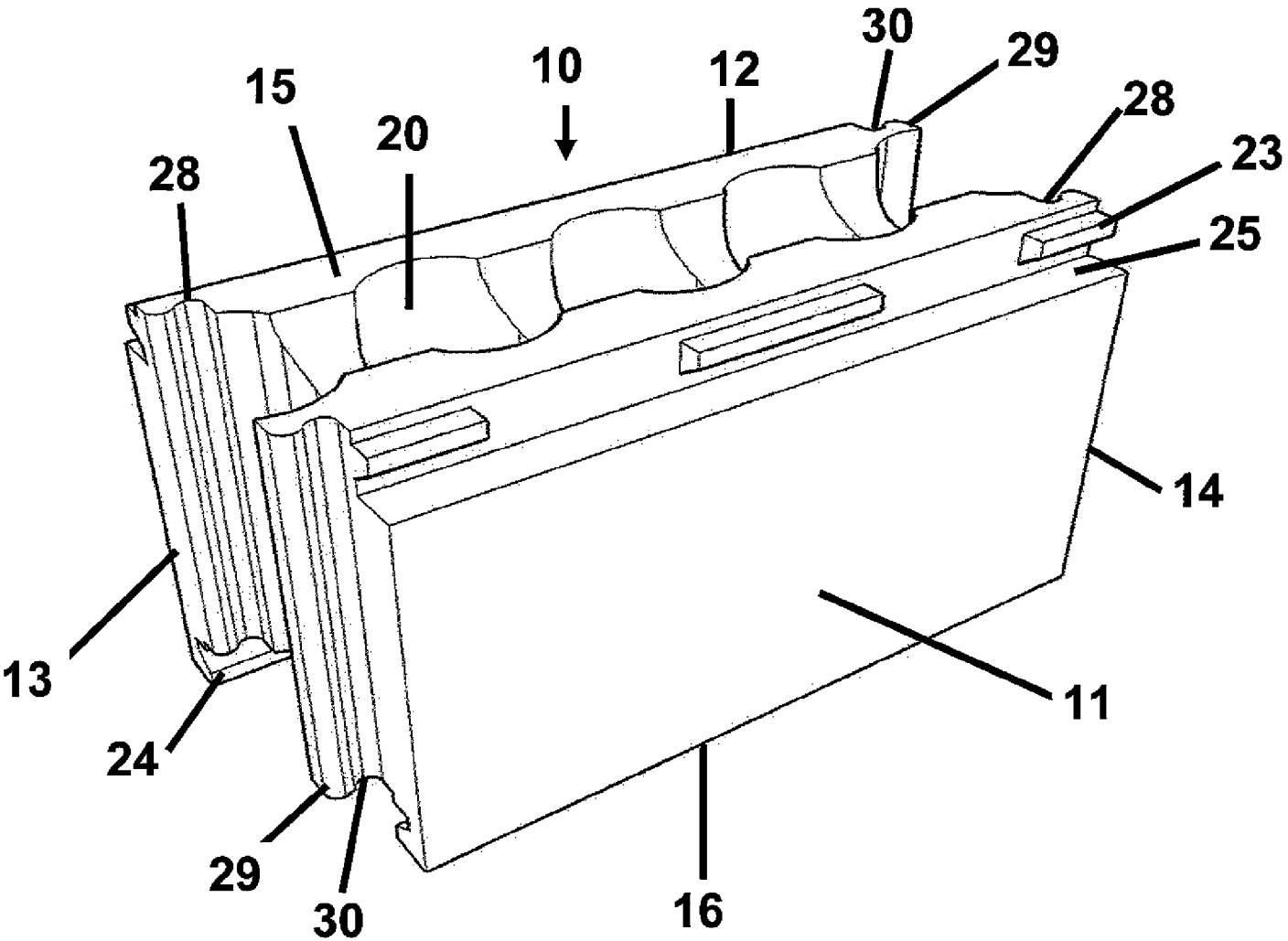
FIG. 1 shows a perspective view of the base block.

In the following description, numerous specific details and options of the present invention are set forth in order to provide a more thorough understanding of the claimed invention. It will be appreciated, however, by one skilled in the art that the building block components may be practiced without such specific details or optional components and that such descriptions are merely for convenience and as such solely selected for the purpose of illustrating the invention. Reference to the figures showing embodiments of the present invention are made to describe the invention and do not limit the scope of the disclosure herein.

For this application the term building components refers to non-masonry blocks including those constructed with plastic polymers, or blends thereof that are constructed in the preferred formations of this disclosure.

A base block 10 of the current invention consists of a front face 11, rear face 12, left end 13, right end 14, upper surface 15 and a lower surface 16. The upper surface 15 and lower surface 16 contain a horizontal concave channel 22 as shown in FIG. 3 that extends from the left end 13 to the right end 14 of the base block 10. Within the horizontal concave channel 22 multiple cylindrical openings 20 extend vertically from the upper surface 15 through the lower surface 16 as shown in FIG. 2.

The front face 11 and the rear face 12 in one embodiment of the block components are essentially smooth planar surfaces. An additional embodiment includes the addition of textures or designs to allow for an aesthetically pleasing finished result both internally and externally of a finished structure. As illustrated in FIG. 3, the front face 11 and the rear face 12 are equally offset from the upper surface 15 to form a horizontal ledge 25 that extends from the left end 13 to the right end 14 shown in FIG. 1. A bottom surface overhang 26, shown in FIG. 3, extends beyond the lower surface 16 of the base block 10 creating a watershed and air tight seal when the building components are vertically affixed to one another.

Figure 2:
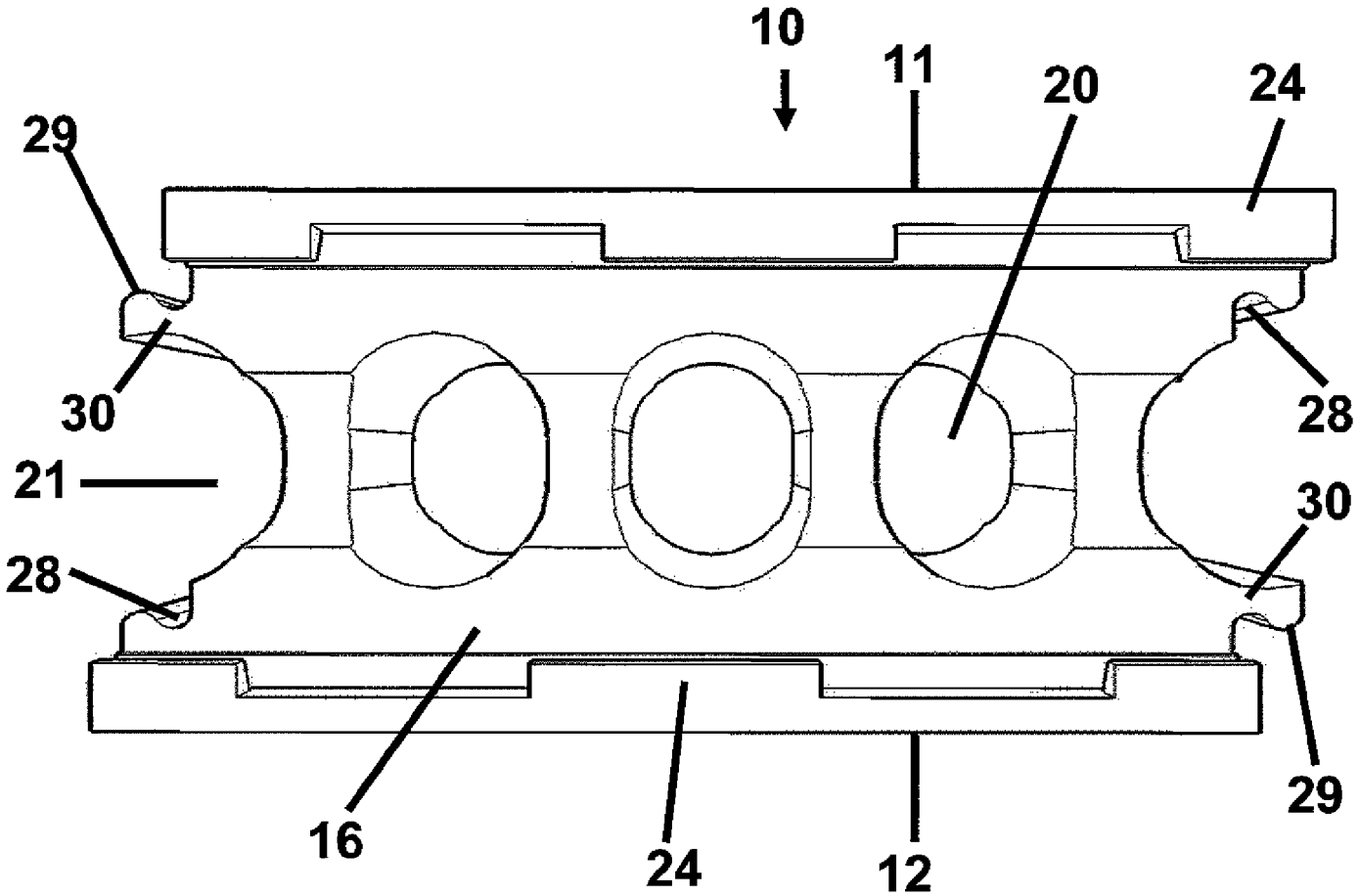
FIG. 2 shows a view of the bottom surface of the base block.
Figure 3:
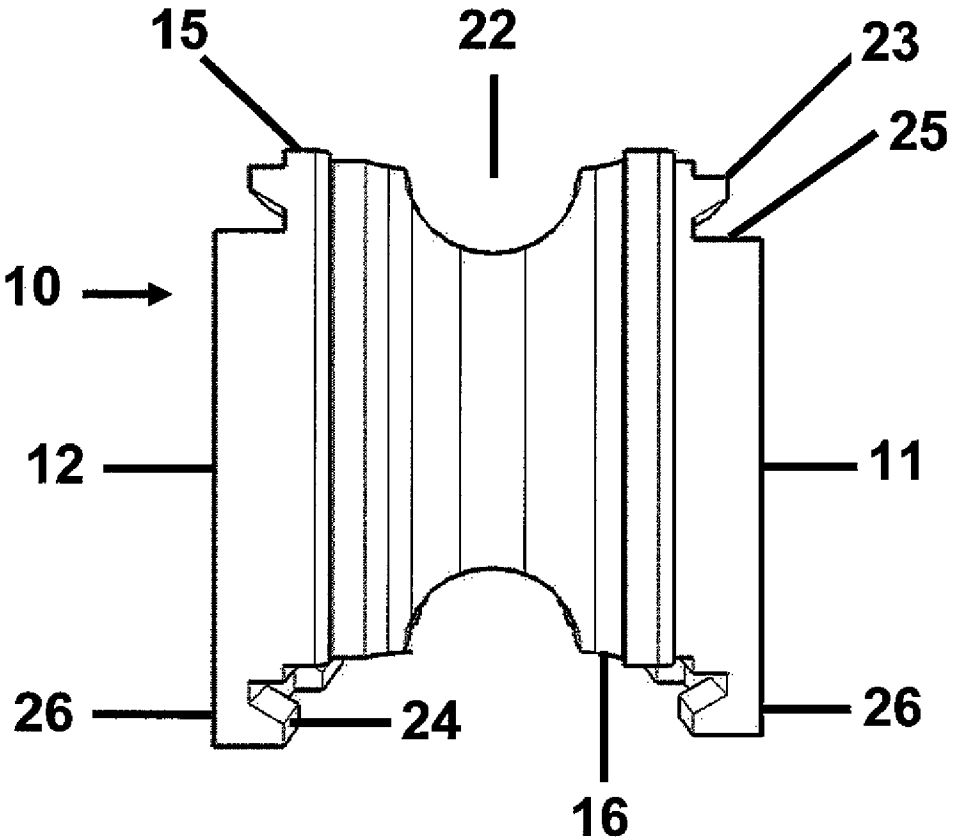
FIG. 3 is a view of the left end of the base block.

As shown in FIG. 2, the left end 13 and right end 14 possess a vertically elongated projection consisting of a bulbous distal end 29 and a flexible proximal end 30 and a complimentary vertical indentation 28. Shown in FIG. 8, the bulbous distal end 29 can be forcibly engaged and seated into the vertical indentation 28 of an adjacent base block 10 with a mallet or similar tool due to flexibility of proximal end 30. Inversely, the blocks can be disassembled using a prying means such as a crowbar or similar tool.

Figure 4:
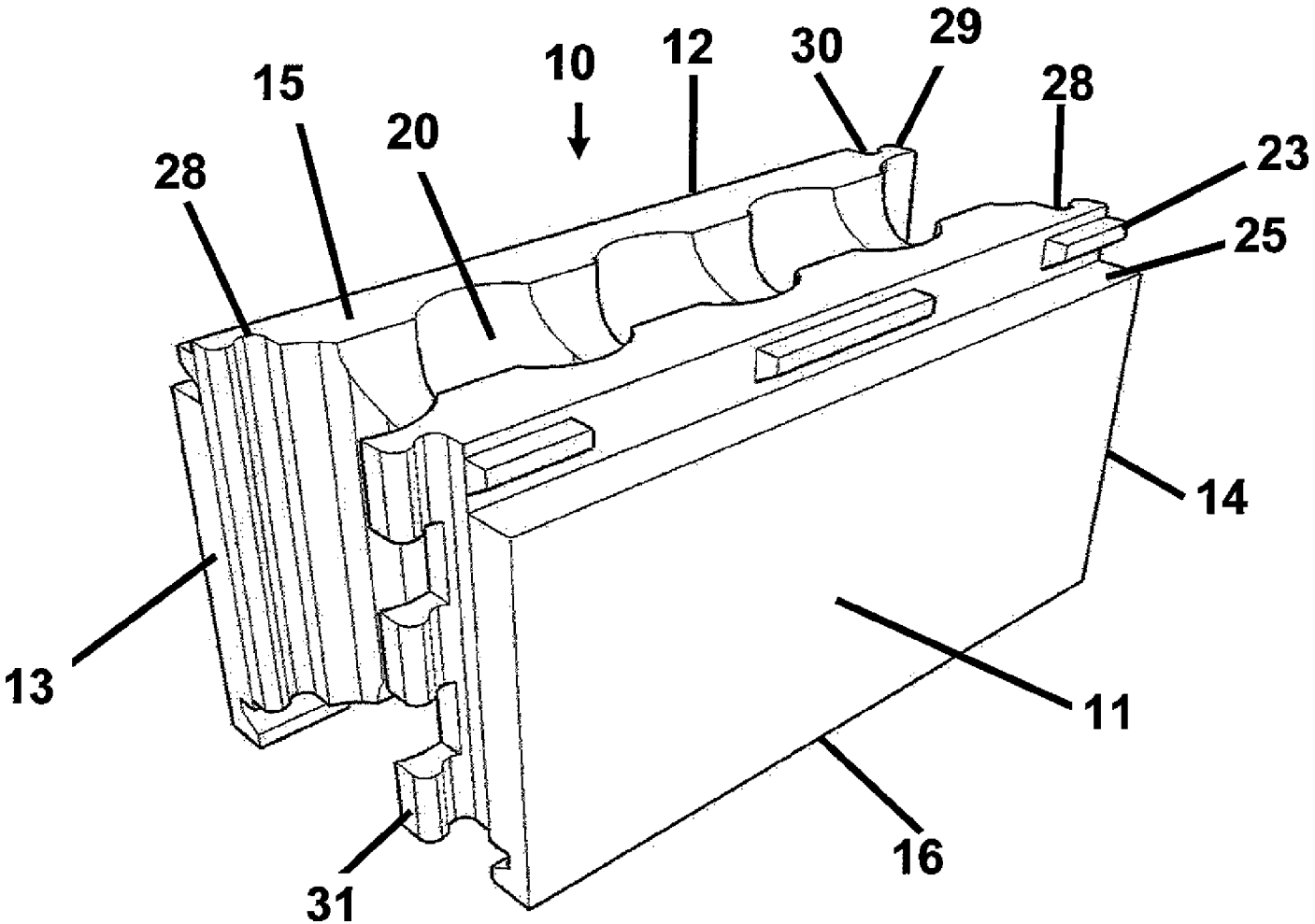
FIG. 4 shows a perspective view of the base block having the broken resistance locking feature.

The thickness of the flexible proximal ends 30 can be modified to adjust the overall resistance of the resistance locking feature 28, 29, 30 of the base block 10 components and to ensure proper functionality. Unlike bonded masonry units the flexibility of the resistance locking feature and the block material precludes the components from breaking or cracking during stress related to the environment or the construction and deconstruction process. One embodiment of the resistance locking feature 28, 29, 30 includes dividing the bulbous distal ends 29 into a plurality of smaller tab-like projections 31, as shown in the perspective view of FIG. 4, to lessen overall resistance.

Figure 8:
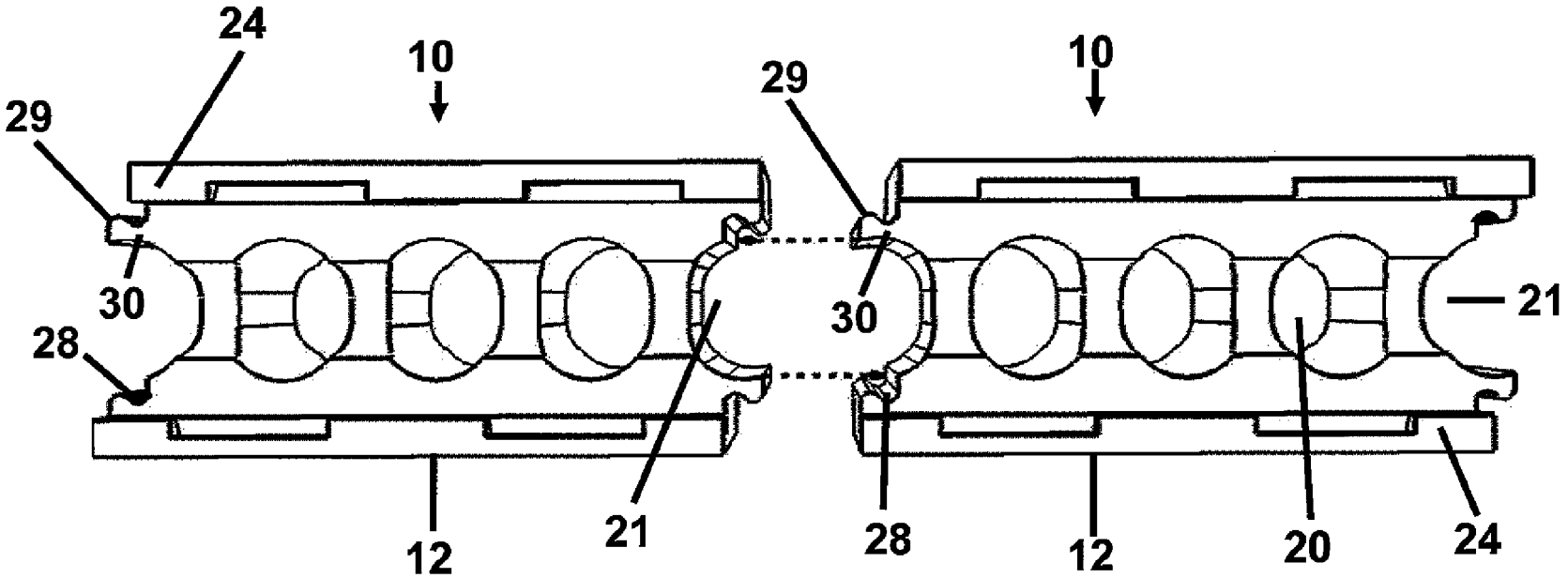
FIG. 8 shows a perspective view of the lower surface of two base blocks illustrating the resistance locking means.
Figure 9:
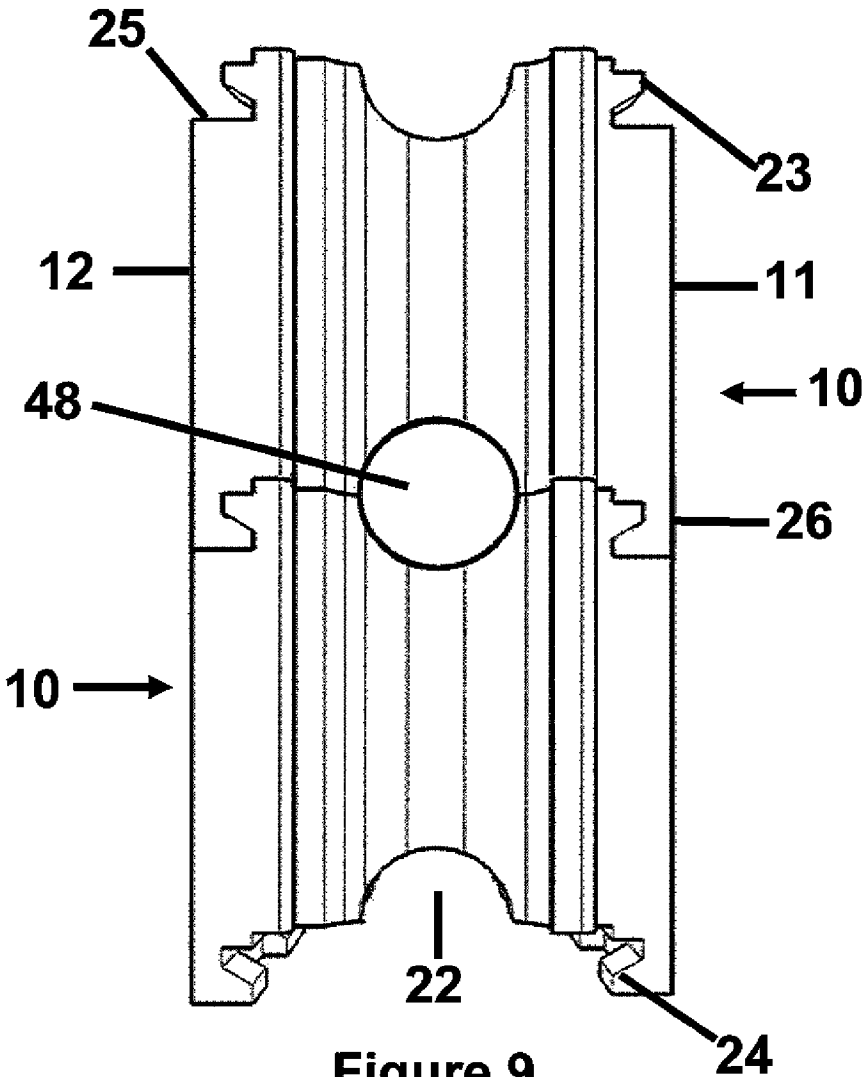
FIG. 9 shows a perspective end view of two coupled base blocks illustrating the adjoining horizontal concave channels.

Additionally, the vertical concave channel 21 running from the upper surface 15 to the lower surface 16 produces a vertical cylindrical opening 20 when additional building components are affixed to one of the respective ends 13,14 as shown in FIG. 8.

Between the horizontal ledge 25 and the upper surface 15 of the front face 11 and the rear face 12, multiple modified horizontal dovetails 23 project outwardly from the base block 10. Complimentary lower surface modified horizontal dovetails 24 are disposed on the bottom surface overhang 26 projecting inwardly as in FIG. 2. The space between the modified horizontal dovetails 23, 24 is of a sufficient width to allow the lower surface dovetails 24 of a base block 10 to be vertically lowered into a space between the upper surface dovetails 23 of a lower base block 10 without force allowing the bottom surface overhang 26 of the upper-most base block 10 to be flush against the horizontal ledge 25 of a lower base block 10.

The upper base block 10 can then be slideably coupled to the lower base block 10 by traversing the lower surface dovetails 24 of the upper base block over the upper surface dovetails 23 of the of the lower block until the dovetails 23,24 are vertically aligned. When affixed in the desired position each base block above the lower-most blocks will be vertically adjacent to four additional base blocks, two from above and two from below. With the dovetails aligned a watershed, air tight, seal is created by the lower surface overhang 26 in addition to a locking means preventing vertical movement of the coupled blocks.

The vertical cylindrical openings 20 of vertically adjacent blocks also become aligned to create an elongated cylindrical opening that traverses the height of the structure. Additionally, the horizontal concave channels 22 of the upper surface 15 and lower surface 16 of each vertically affixed block creates a horizontal cylindrical opening 48 which traverses the width of the wall or structure, as is shown in FIG. 8.

Figure 5:
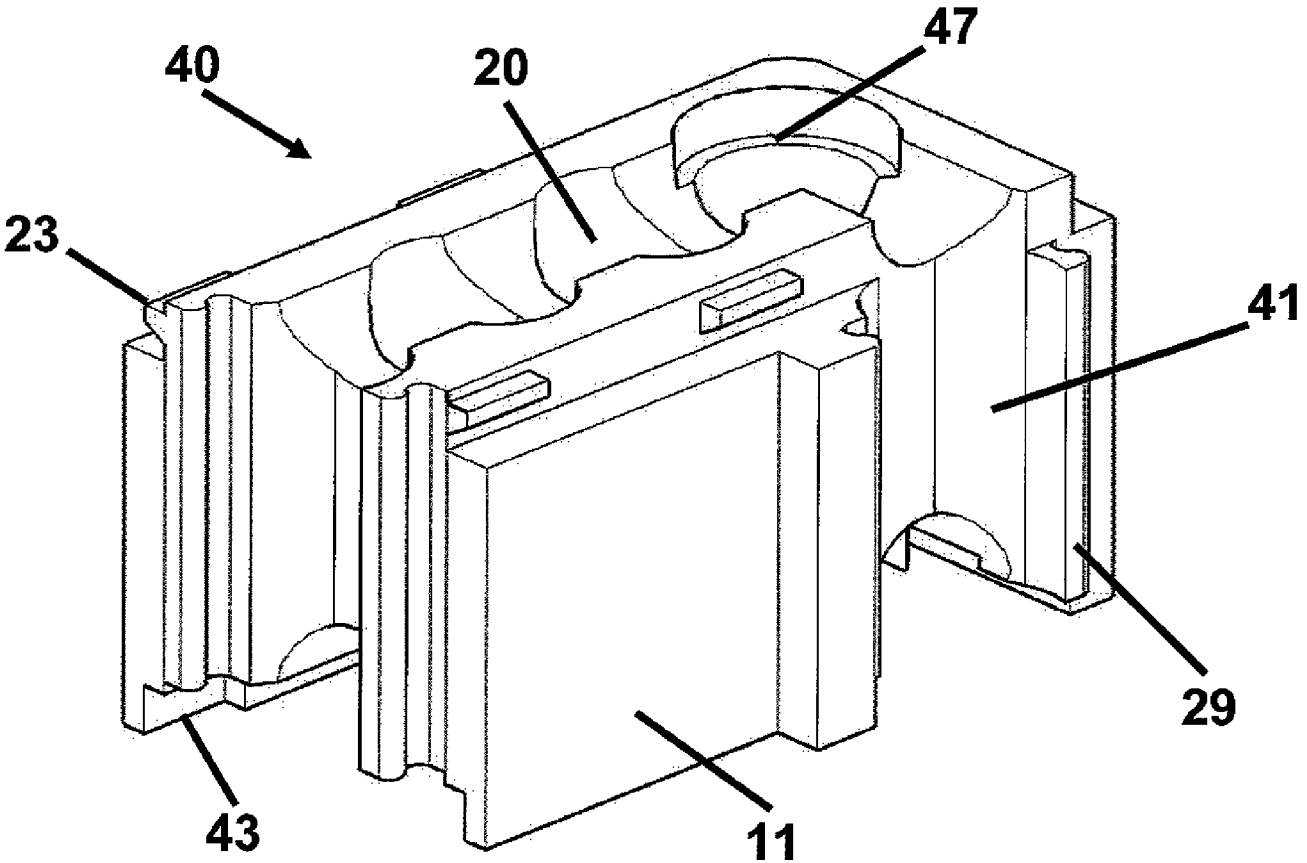
FIG. 5 shows a perspective view of the upper surface of the right corner block.
Figure 7:
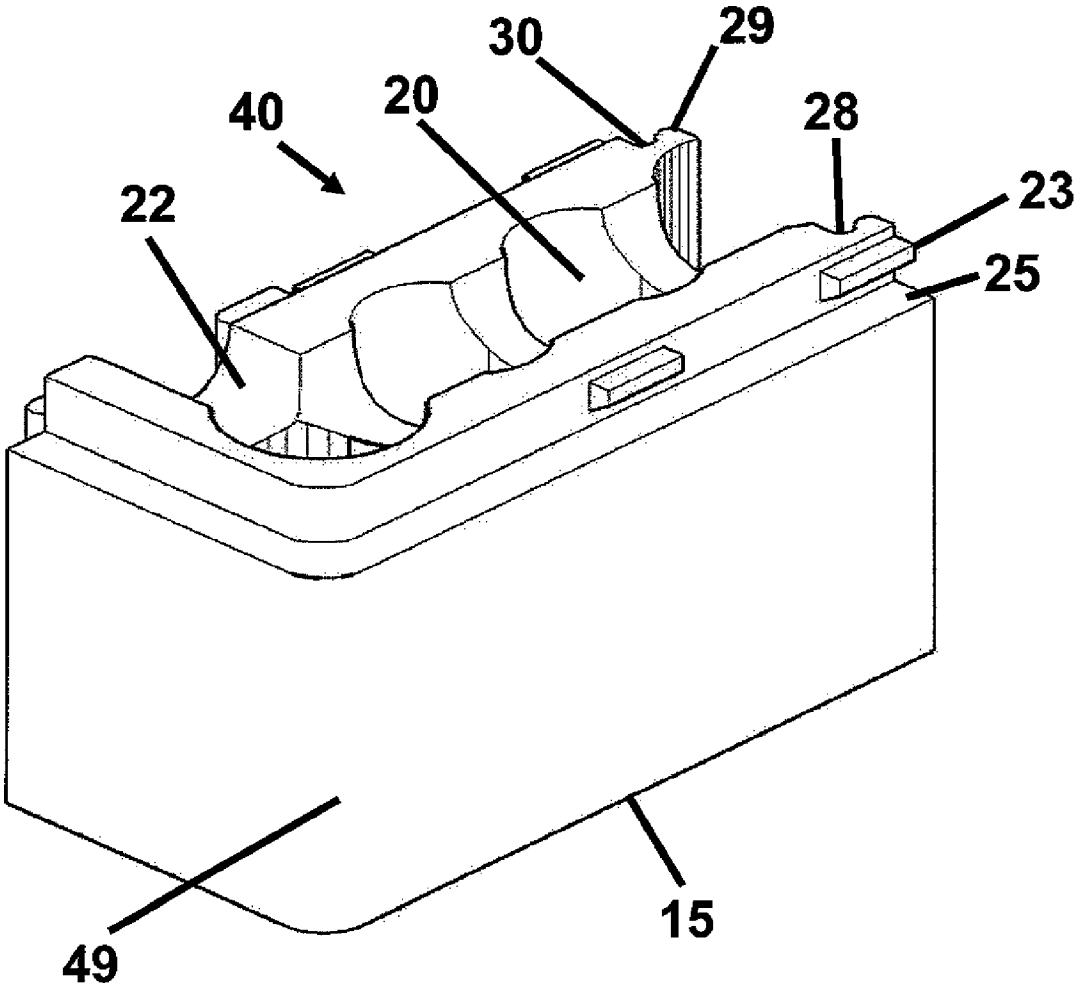
FIG. 7 shows a perspective view of the external surface of the right corner block.

A left corner block and a right corner block 40 can be incorporated into the use of the present invention to complete the perimeter of the external walls of a resulting structure. The corner blocks being of equivalent size and structure of the base blocks 10 possess modifications necessary to complete the ninety degree turn and allow for a vertical connection which is a necessity due to the lack of horizontal space remaining when base blocks 10 have been disposed on either side of the final block. The left end 13 or right end 14 as described in the base block components, and the equivalent structures found therein, are turned ninety degrees placing the turning end 41 on what was previously described as the front face 11 of the base block, as shown in FIG. 5, with complimentary adjustments made for the left corner block. This modification to the base block 10 also leaves a curved smooth finish 49 on the externally exposed face of the corner block as seen in FIG. 7. The curved smooth finish 49 may also be altered as described for the base block 10 to provide a more aesthetic appearance.

Figure 6:
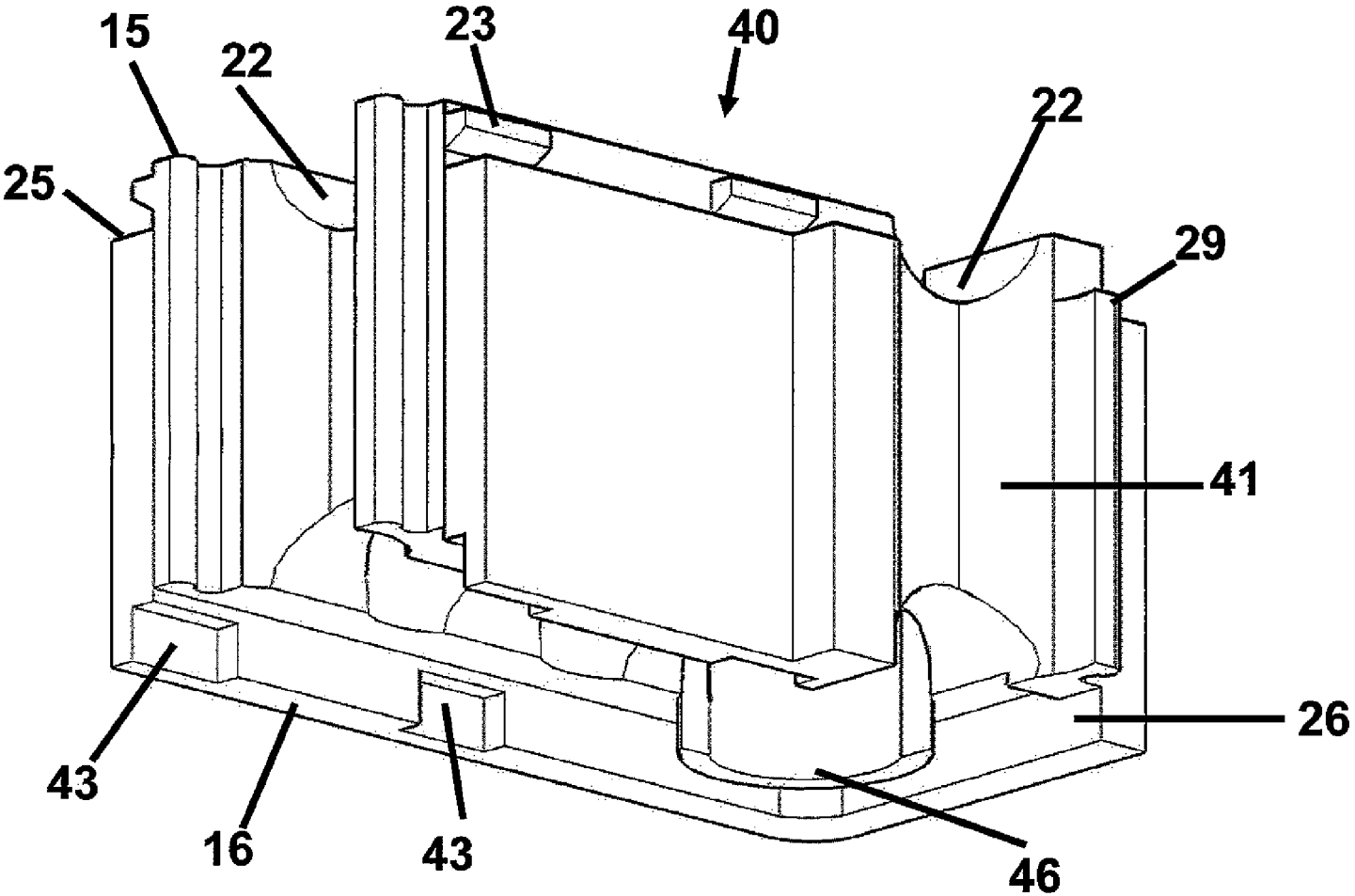
FIG. 6 shows a perspective view of the lower surface of the right corner block.

The modified dovetails 23 and the previously defined resistance locking feature 28, 29, 30 of the base block 10 are also present on the corner blocks with some modifications due to the unavailability of space when affixing the final block. The lower surface dovetails 24, as described in the base block 10, are removed on the corner blocks and rectangular voids 45 in the lower surface overhang 26 are disposed in their place with the exception of the dovetail 24 that would be located nearest the turning end 41, which is removed as illustrated in FIG. 6. The dovetails 23 of the upper surface 15 of the corner blocks are also retained with the exception of the dovetail 23 that would be located on the turning end 41 which is also removed as shown in FIG. 5.

The resistance locking feature 28, 29, 30 of the base blocks 10 are also present on the corner blocks 40 and are engaged by vertically coupling, with a mallet or similar tool, the corner blocks 40 to the existing resistance locking feature 28,29,30 of two adjacent base blocks 10. When the corner block is fully engaged to the resistance lock of each adjacent block, the rectangular voids 43 disposed on the bottom surface of the corner block will enclose the dovetails 23 of the corner block located beneath it to further prevent horizontal movement.

An additional stabilizing modification to the corner block is the inclusion of a partial circular projection 46 which extends from the lower surface 16 of the block which partially traverses the cylindrical opening 20 nearest the turning end 40 of the corner block. The partial circular projection 46 terminates at the horizontal concave channel 22 of the lower surface 16 of the corner block 40. A corresponding upper surface circular indentation forms a circular ledge 47 in which the partial circular projection 46 can be lowered therein. The horizontal concave channel 22 of the corner block 40 follows the turning end ninety degrees to create an essentially L-shaped channel in which plumbing, electrical conduit or strengthening materials can be disposed therein. For additional support rebar or equivalent structures can be placed through the aligned cylindrical openings 20 of the stacked corner blocks.

The invention claimed is:

1. A non-masonry block component, said block component comprising:

an upper surface, lower surface, right end, left end, front face and rear face;

a plurality of modified dovetails horizontally disposed and equally spaced near said upper surface and said lower surface adjacent to said front face and said rear face; said modified dovetails adjacent to said upper surface projecting outwardly relative to said front face and said rear face; and said modified dovetails adjacent to said lower surface projecting inwardly relative to said front face and said rear face;

a plurality of vertical cylindrical hollows;

a vertical concave channel disposed on said left end and said right end of each component; and a horizontal concave channel disposed on said upper surface and said lower surface of said block component.

2. A non-masonry block component of claim 1, wherein the surface of said front face and said rear face is essentially smooth.

3. A non-masonry block component of claim 1, wherein the surface of said front face and said rear face is textured or colored to create an aesthetically pleasing finish.

4. A non-masonry block component of claim 1, wherein said left end and said right end of said block comprises a flexible proximal end;

a bulbous distal end; and a vertical indentation.

5. A non-masonry block component of claim 1, wherein said plurality of vertical cylindrical hollows of each block component align with said plurality of cylindrical hollows of vertically adjacent block components.

6. A non-masonry block component of claim 1, wherein said block component has a hollow body.

7. A method of forming a protective barrier from the non-masonry component of claim 6:

providing a plurality of non-masonry block components; and introducing sand into said hollow body to constitute insulation or a protective barrier.

* * * * *